US007562497B2

(12) United States Patent
Warren

(10) Patent No.: US 7,562,497 B2
(45) Date of Patent: Jul. 21, 2009

(54) ARCHED DOOR FRAME

(76) Inventor: Douglas A. Warren, 16154 MacKenzie Lake Way SE., Calgary, Alberta (CA) T2J 1M4

( * ) Notice: Subject to any disclaimer, the term of this patent is extended or adjusted under 35 U.S.C. 154(b) by 580 days.

(21) Appl. No.: 11/258,797

(22) Filed: Oct. 27, 2005

(65) Prior Publication Data

US 2007/0113498 A1 May 24, 2007

(51) Int. Cl.
*E04B 1/32* (2006.01)

(52) U.S. Cl. ..... 52/86; 52/211; 52/85; 52/88

(58) Field of Classification Search ..... 52/85, 52/86, 88, 211, 585.1, 584.1; 405/151
See application file for complete search history.

(56) References Cited

U.S. PATENT DOCUMENTS

| | | | | | |
|---|---|---|---|---|---|
| 1,931,889 | A | | 10/1933 | Brainard et al. | |
| 2,005,572 | A | | 6/1935 | Vass | |
| 2,011,796 | A | | 8/1935 | Christensen | |
| 2,064,704 | A | | 12/1936 | Vass | |
| 2,077,137 | A | * | 4/1937 | Wilkoff | 405/151 |
| 2,235,356 | A | * | 3/1941 | Byers | 52/582.1 |
| 3,008,273 | A | | 11/1961 | Widin | |
| 3,421,269 | A | | 1/1969 | Medow | |
| 3,842,557 | A | | 10/1974 | Brown | |
| 3,968,604 | A | * | 7/1976 | Hills | 52/86 |
| 3,984,956 | A | * | 10/1976 | Oger et al. | 52/249 |
| 4,037,417 | A | * | 7/1977 | Oger | 405/151 |
| 4,301,632 | A | | 11/1981 | Wagner | |
| 4,315,390 | A | | 2/1982 | Schaafsma | |
| 4,318,637 | A | * | 3/1982 | Oger et al. | 405/153 |
| 4,400,917 | A | | 8/1983 | Massaro et al. | |
| 4,594,026 | A | * | 6/1986 | Hauer et al. | 405/153 |
| 4,601,138 | A | | 7/1986 | Hampton | |
| 4,644,710 | A | * | 2/1987 | Lippe | 52/86 |
| 4,665,666 | A | | 5/1987 | Hampton | |
| 4,765,103 | A | * | 8/1988 | Clarke | 52/86 |
| 4,876,828 | A | * | 10/1989 | Brill | 52/23 |
| 5,115,605 | A | * | 5/1992 | Butler | 52/105 |
| 5,385,423 | A | * | 1/1995 | Abukawa | 403/245 |

(Continued)

FOREIGN PATENT DOCUMENTS

| | | |
|---|---|---|
| CA | 358640 | 6/1936 |

(Continued)

*Primary Examiner*—Richard E Chilcot, Jr.
*Assistant Examiner*—Alp Akbasli
(74) *Attorney, Agent, or Firm*—Sean W Goodwin; Linda M Thompson

(57) ABSTRACT

An arched door frame for use within an arched opening in a framed, wallboard clad wall comprises: two similar door frame side portions each having a lower straight portion, an upper rounded portion, and an upper connection edge portion; wherein each door frame side portion has a jamb having a width generally equal to a stud width and two thicknesses of wallboard, and a contoured casing attached to both a front and rear edge portion of the jamb; and, frame side alignment and connection maintenance means to centrally align and maintain the two frame side portions in close proximity. In a preferred aspect the frame alignment means comprises clip holes and dowels, and the connection maintenance means comprises a front and back U shaped clip having opposite ends which are received in the clip holes, one clip hole in an outer edge of each jamb side portion.

15 Claims, 1 Drawing Sheet

U.S. PATENT DOCUMENTS

| | | | | |
|---|---|---|---|---|
| 5,526,618 | A * | 6/1996 | Thomas | 52/211 |
| 5,572,834 | A | 11/1996 | Lilly | |
| 5,651,220 | A * | 7/1997 | dit Felix | 52/81.5 |
| 5,671,583 | A | 9/1997 | Turner | |
| 6,128,864 | A | 10/2000 | Barry et al. | |
| 6,161,342 | A * | 12/2000 | Barbier et al. | 52/86 |
| 6,173,937 | B1 * | 1/2001 | Cottongim | 249/40 |
| 6,195,945 | B1 | 3/2001 | McGarry et al. | |
| 6,253,516 | B1 * | 7/2001 | D'Andrea et al. | 52/582.1 |
| 6,401,405 | B1 | 6/2002 | Hicks | |
| 6,408,576 | B1 | 6/2002 | Roth | |
| 6,511,250 | B2 * | 1/2003 | Lindsay | 403/230 |
| 6,662,512 | B2 * | 12/2003 | Westphal | 52/204.5 |
| 6,854,219 | B1 * | 2/2005 | Kelly et al. | 52/86 |
| 6,898,903 | B1 * | 5/2005 | Thomas | 52/86 |
| 6,931,797 | B2 * | 8/2005 | Drew | 52/86 |
| 7,146,767 | B2 * | 12/2006 | Smerud | 52/88 |
| 7,243,468 | B2 * | 7/2007 | Wright | 52/306 |
| 7,347,441 | B2 * | 3/2008 | Rosario | 280/507 |
| 7,389,618 | B1 * | 6/2008 | Herkstroeter et al. | 52/285.3 |

FOREIGN PATENT DOCUMENTS

| | | |
|---|---|---|
| CA | 2088858 | 2/1993 |
| CA | 2124040 | 5/1994 |
| CA | 2241586 | 6/1998 |

* cited by examiner

ARCHED DOOR FRAME

FIELD OF THE INVENTION

This invention relates to finishing arched doorways. More particularly this invention relates to a unique method of finishing an arched door in a building wall using a two piece door frame having a jamb and casing attached thereto. If the door frame includes a stop then the archway is suitable for hanging an arched top door therein.

BACKGROUND OF THE INVENTION

An arched doorway creates an artistic appeal and an elegance in a room which a rectangular door frame lacks. The problem with utilizing arched doorways is that their conventional construction is both complicated and time consuming. Most tradesmen who hang and finish wallboard are not prepared to provide arched doorways. Detailed layout is not something these tradesmen usually do, or normally need to know. These problems to some degree have been overcome by three piece archway kits which are sold to simplify and speed up the construction of an arched doorway in a framed rectangular opening. These three piece kits have joints on opposite straight side portions, and an arched top portion which spans across between the opposite sides. The door frame portions in the arched door way kit normally include door jams and casings. Typically wall board is hung both around the straight side portions of the doorway, and left hanging down over what will become the top arched portion of the framed doorway. The straight side portions are first installed, the drywall hanging over the top central portion of the door way is next arched, and then the central portion is installed over the top arched opening in the doorway, adjacent to and over the straight side portions. The arched central member is installed over as well as adjacent to the straight side portions in order to cover the joint therebetween. This results in what looks like a flared header, or is known as a capital, on both sides of the doorframe. This capital protrudes into the door opening and makes the installation of any door covering the opening difficult. Another problem with this construction method is weakness in the joints between the straight side portion and central arched portion. The arch requires additional framing within the interior corner portions of the rectangular opening to provide sufficient support to the arched wallboard. Another problem with many of these three piece archway kits is that they utilize capitals or flared headers to cover the joint between the opposite side straight portions of the door jam and the top overhead arched portion thereof. These capitals extend inwardly into the door opening making it more difficult to hang a swinging door in the opening.

OBJECTS OF THE INVENTION

It is an object of this invention to disclose a prefabricated arch construction kit. It is an object of this invention to disclose an arch construction kit which will inherently provide adequate support adjacent to the arch within a rectangular framed opening without the need for additional angular framing. It is yet a further object of this invention to disclose a prefabricated arch construction kit which has a minimal number of pieces and a system which maintains those pieces in close proximity without the need to cover the gap with an additional board. Lack of an additional board not only reduces cost, but lack of a gap covering board which protrudes into the door opening allows a door to be hung within the arched opening. Capitols are inconsistent with common contemporary styling.

One aspect of this invention provides for an arched door frame for use within an arched opening in a framed, wallboard clad wall comprises: two similar door frame side portions each having a lower straight portion, an upper rounded portion, and an upper connection edge portion; wherein each door frame side portion has a jamb having a width generally equal to a stud width and two thicknesses of wallboard, and a contoured casing attached to both a front and rear edge portion of the jamb; and, frame side alignment and connection maintenance means to centrally align and maintain the two frame side portions in close proximity.

In a preferred aspect of the invention the frame alignment means comprises clip holes and dowels in the upper connection edge of one of the door frame side portions, and wherein the connection maintenance means comprises a front and back U shaped clip having opposite ends which are received in the clip holes, one clip hole in an outer edge of each jamb side portion, said clip holes positioned therein to maintain the door frame side portions in close proximity when the U shaped clips are inserted therein.

A method of constructing an arched door frame in a framed rectangular wall opening comprises the steps of: a) attaching wallboard around the lower straight side portions of the opening; b) attaching wallboard around and across the upper arched portion of the opening; c) roughly marking the upper portion of the arch on the wallboard and removing the interior side portion of the arch; d) positioning one side portion of the door frame within the arched opening; e) positioning the other side portion of the door frame within the arched opening; f) using a frame side alignment and connection maintenance means to centrally align and maintain the two frame side portions in close proximity; and thereafter, g) attaching the two side portions of the door frame to the studs in the framed wall.

Various other objects, advantages and features of this invention will become apparent to those skilled in the art from the following description in conjunction with the accompanying drawings.

FIGURES OF THE INVENTION

Figure 1:
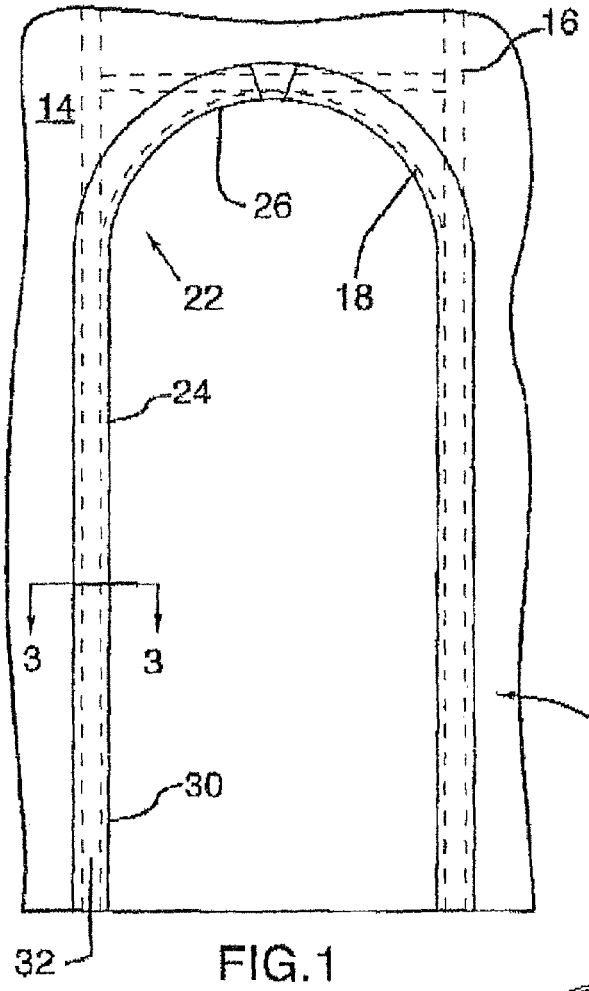
FIG. 1 is a front view of an arched door frame mounted within an arched opening in a framed wall clad with wallboard.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a front view of an arched door frame 20 mounted within an arched opening 18 in a framed wall 16 clad with wallboard 14. Most generally the arched door frame 20 comprises: two similar door frame side portions 22 each having a lower straight portion, an upper rounded portion, and an upper connection edge portion 28. Each door frame side portion 22 has a jamb 30 having a width generally equal to a stud 16 width and two thicknesses of wallboard 14, and a contoured casing 32 attached to both a front and rear edge portion of the jamb 30. Frame side alignment and connection maintenance means 34 are used to centrally align and maintain the two frame side portions 22 in close proximity.

Figure 2:
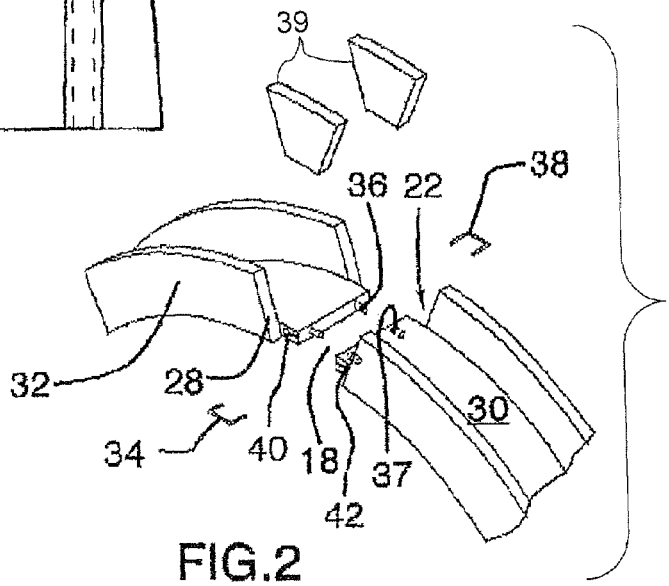
FIG. 2 is a perspective view of a top portion of the two piece arched door frame separated to show attachment configuration.

FIG. 2 is a perspective view of a top portion of the two piece arched door frame 20 separated to show attachment configuration. In a preferred embodiment of the invention the frame alignment means 34 comprises dowels 36 and dowel holes 37 in the upper connection edge 28 of one of the door frame side portions 22, and wherein the connection maintenance means 34 comprises a front and back U shaped clip 38 having opposite ends which are received in the two clip holes 40, one clip hole in an outer edge of each jamb side portion 42, said clip holes 40 positioned therein to maintain the door frame side portions 22 in close proximity when the U shaped clips 38 are inserted therein. In the most preferred embodiment of the invention casing keys 39 are provided to maintain continuity between the top central side portions of the casing 32 after the side portions of the door frame 22 are connected.

Figure 3:
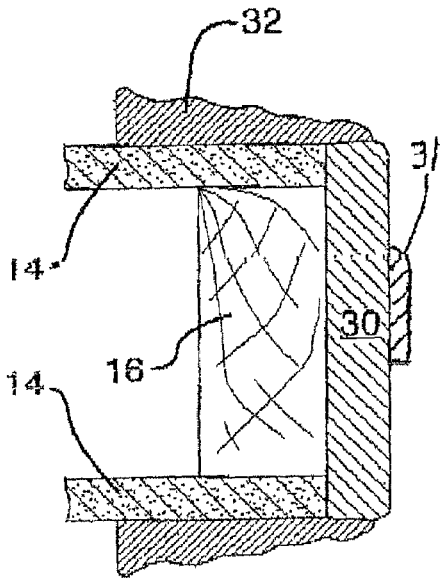
FIG. 3 is a cross sectional view taken along line 3-3 in FIG. 1.

FIG. 3 is a cross sectional view taken along line 3-3 in FIG. 1. In the most preferred embodiment of the invention the jambs 30 comprise a wood laminate. The contoured casing 32 comprises a medium density fiberboard (MDF) having a contoured outer side portion. Medium density fiberboard (MDF) is a generic name for a board constructed from fiber which is sold under the brand names PLUM CREEK™ by plum Creek Inc., and RANGER BOARD™ by Weldwood Inc. The door side frame portions 22 are sold fully assembled each having a singular curved jamb 30 having front and rear casing 32 attached to opposite edges thereof, so that each side may be inserted within the arch shaped opening 18 within the wallboard 14 clad, framed 16 wall prior to central attachment of the two door side frame portions 22 using the frame side connection maintenance means 34. If an arched door (not shown) is desired to be hung in the door frame 20 then the door frame 20 further comprises a stop 31.

Arched door frames 20 are dimensioned to fit either 4" or 6" nominally dimensioned stud walls 16. The door frames 20 are dimensioned for standard width, 30, 32, 34, and 36" wide door framed door openings 18.

A general method of constructing an arched door frame 20 in a framed rectangular wall opening 18 comprises the steps of: a) attaching wallboard 14 around the lower straight side portions of the opening 18; b) attaching wallboard 14 around and across the upper arched portion of the opening 18; c) roughly marking the upper portion of the opening 18 on the wallboard 14 and removing the interior side portion thereof; d) positioning one side portion 22 of the door frame 20 within the opening 18; e) positioning the other side portion 22 of the door frame 20 within the opening 18; f) using a frame side alignment and connection maintenance means 34 to centrally align and maintain the two frame side portions 22 in close proximity; and thereafter, g) attaching the two side portions 22 of the door frame 20 to the framed wall 16. This general method may further comprise the step of aligning the frame side portions 22 using dowels 36 and maintaining the frame side portions 22 in alignment by inserting the U shaped clips 38 in the clip holes 40. This general method may further comprise the step of positioning and attaching casing keys 39 between the top central side portions of the casing 32 attached to the door frame side portions 22.

While the invention has been described with preferred specific embodiments thereof, it will be understood that this description is intended to illustrate and not to limit the scope of the invention, which is defined by the following claims.

I claim:

1. An arched door frame for use within an arched opening in a framed, wallboard-clad wall comprising:

two similar door frame side portions each having a lower straight portion;

an upper rounded portion;

an upper connection edge portion;

a jamb having a width generally equal to a stud width and two thicknesses of wallboard; and a contoured casing attached to both a front and rear edge portion of the jamb;

dowels in the upper connection edge of one of the door frame side portions and dowel holes in the upper connection edge portion of the other door frame side portion for centrally aligning the two frame side portions in close proximity;

a front and back U shaped clip having opposite ends which are received in clip holes, one clip hole in an outer edge of each iamb side portion, said clip holes positioned therein to maintain the door frame side portions in close proximity when the U shaped clips are inserted therein; and casing keys positioned between the contoured casing of the two similar door frame side portions at the upper rounded portion of the frame side portions for providing a continuous arch of contoured casing when the two similar door frame side portions are aligned and maintained in close proximity.

2. The arched doorway of claim 1 wherein the door frame side portions further comprise a stop so that an arched door may be hung therein.

3. The arched door frame of claim 1 wherein the jamb comprises a wood laminate.

4. The arched door frame of claim 1 wherein the casing comprises a medium density fiberboard having a contoured outer side portion.

5. The arched door frame of claim 1 wherein the door side frame portions are fully assembled each having a singular curved jamb having front and rear casing attached to opposite edges thereof, so that each side may be inserted within the arch shaped opening within the framed, wallboard covered wall prior to central attachment of the two door side frame portions using the frame side connection maintenance means.

6. The arched door frame of claim 1 wherein the door frames are dimensioned for stud walls.

7. The arched door frame of claim 1 wherein the door frames are dimensioned for standard width framed openings.

8. An arched door frame for use within an arched opening in a framed, wallboard-clad wall comprising:

two similar door frame side portions each having a lower straight portion;

an upper rounded portion;

an upper connection edge portion;

a jamb having a width generally equal to a stud width and two thicknesses of wallboard; and a contoured casing attached to both a front and rear edge portion of the jamb;

connectors for centrally aligning and maintaining the two frame side portions in close proximity; and casing keys positioned between the contoured casing of the two similar door frame side portions at the upper rounded portion for providing a continuous arch of contoured casing when the two similar door frame side portions are aligned and maintained in close proximity.

9. The arched door frame of claim 8 wherein the connectors comprise:

dowels in the upper connection edge of one of the door frame side portions and dowel holes in the upper connection edge of the other of the door frame side portions, and a front and back U shaped clip having opposite ends which are received in clip holes, one clip hole in an outer edge of each jamb side portion, said clip holes positioned therein to maintain the door frame side portions in close proximity when the U shaped clips are inserted therein.

10. The arched doorway of claim 8 wherein the door frame side portions further comprise a stop so that an arched door may be hung therein.

11. The arched door frame of claim 8 wherein the jamb comprises a wood laminate.

12. The arched door frame of claim 8 wherein the casing comprises a medium density fiberboard having a contoured outer side portion.

13. The arched door frame of claim 8 wherein the door side frame portions are fully assembled, each having a singular curved jamb having front and rear casing attached to opposite edges thereof, so that each side may be inserted within the arch shaped opening within the framed, wallboard covered wall prior to central attachment of the two door side frame portions using the frame side connection maintenance means.

14. The arched door frame of claim 8 wherein the door frames are dimensioned for stud walls.

15. The arched door frame of claim 8 wherein the door frames are dimensioned for standard width framed openings.

* * * * *